United States Patent [19]

Jones

[11] 4,331,001

[45] May 25, 1982

[54] ACCUMULATOR-DEHYDRATOR ASSEMBLY FOR AN AIR CONDITIONING SYSTEM

[75] Inventor: Joe W. Jones, Dayton, Ohio

[73] Assignee: General Motors Corporation, Detroit, Mich.

[21] Appl. No.: 262,189

[22] Filed: May 11, 1981

[51] Int. Cl.[3] ..... F25B 43/00

[52] U.S. Cl. ..... 62/503; 55/192; 62/474

[58] Field of Search ..... 62/503, 474, 475, 217; 55/199, 192, 35; 210/DIG. 6

[56] References Cited

U.S. PATENT DOCUMENTS

| | | | |
|---|---|---|---|
| 3,084,523 | 4/1963 | Bottum et al. | 62/296 |
| 3,759,062 | 9/1973 | Wrenn et al. | 62/474 |
| 3,798,921 | 3/1974 | Scherer et al. | 62/217 |
| 3,824,802 | 7/1974 | Scherer et al. | 62/217 |
| 3,858,407 | 1/1975 | Schumacher | 62/503 |
| 4,111,005 | 9/1978 | Livesay | 62/503 |
| 4,270,934 | 6/1981 | Widdowson et al. | 62/503 |
| 4,291,548 | 9/1981 | Livesay | 62/503 |

*Primary Examiner*—Ronald C. Capossela
*Attorney, Agent, or Firm*—R. L. Phillips

[57] ABSTRACT

An accumulator-dehydrator assembly is disclosed in a vehicle air conditioning system wherein refrigerant and oil and possibly water are circulated. All vapor components are forced to pass through a desiccant to allow the desiccant to effectively adsorb any water entrained therein and liquid refrigerant and oil are collected and eventually atomized for continued circulation with the vapor components passing through the desiccant.

3 Claims, 2 Drawing Figures

ACCUMULATOR-DEHYDRATOR ASSEMBLY FOR AN AIR CONDITIONING SYSTEM

This invention relates to an accumulator-dehydrator assembly for an air conditioning system wherein refrigerant and oil and possibly water are circulated.

In air conditioning systems such as those employed in vehicles, it is common practice to employ an accumulator-dehydrator device, often times referred to as a suction accumulator, between the evaporator and the compressor. The purpose of such device is to ensure delivery of the refrigerant in a vapor phase to the compressor's suction side and remove any water from circulation. Moreover, in those air conditioning systems where oil is also circulated for lubrication of the compressor, it is desirable that it be maintained in the vapor flow to the compressor. Various accumulator-dehydrator designs have been proposed for satisfying these various requirements however, they are typically efficient in satisfying just some of these requirements and not a panacea.

The present invention is directed to providing an accumulator-dehydrator assembly which is highly efficient in all respects but is yet relatively simple in structure. In the preferred embodiment, this is accomplished with a casing having a top and a bottom and an inlet for receiving refrigerant and oil and an outlet for discharging same. A container is supported in the casing adjacent the top thereof and contains a desiccant exposed to the interior. A vapor passage is then provided having an inlet located within the desiccant in the container and an outlet connected to the casing outlet. The desiccant container has an exterior forming a baffle in the path of the casing inlet to stimulate separation of the refrigerant and oil into liquid and vapor components with the latter stratifying about the desiccant container while the liquid components collect on the bottom of the casing. As a result, all the vapor components in the casing are forced to pass through the desiccant and thence out the vapor passage to the casing outlet thereby allowing the desiccant to very effectively adsorb any water entrained therein.

In addition, there is provided a restricted liquid passage having an inlet located in the bottom of the casing and an outlet connected to the vapor passage at a point intermediate its inlet and outlet. As a result, the flow through the vapor passage from the desiccant produces a venturi effect which induces restricted liquid refrigerant and oil flow through the liquid passage and thence limited atomized refrigerant and oil flow with the vapor components out through the vapor passage to the casing outlet. Thus, refrigerant and oil flow only in vapor form is very effectively provided to the compressor while any water is very effectively prevented from reaching the compressor.

These and other objects and advantages of the present invention will become more apparent from the following description and drawing in which.

Figure 1:
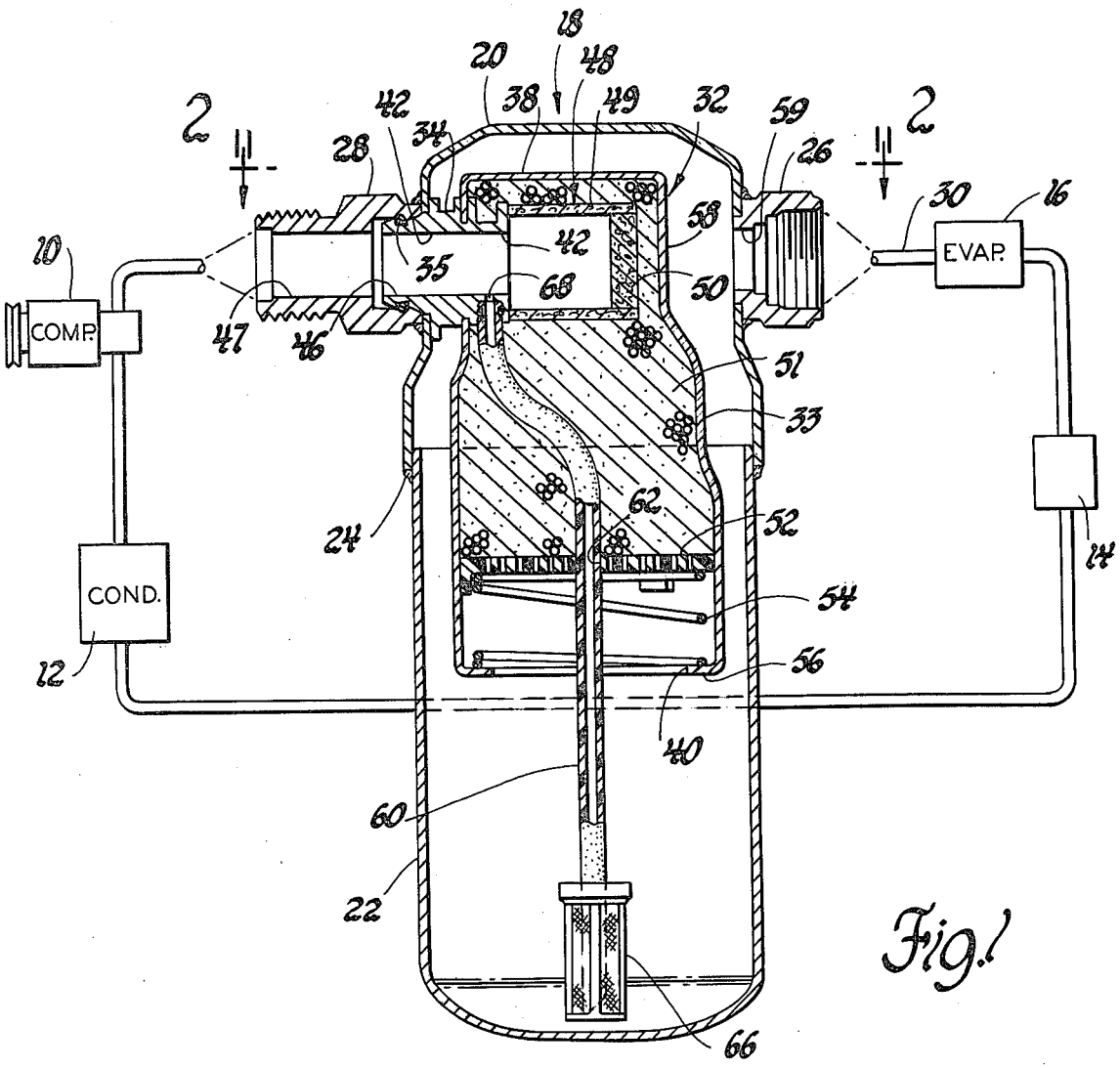
FIG. 1 is a schematic view of a vehicle air conditioning system having incorporated therein the presently preferred embodiment of the accumulator-dehydrator assembly according to the present invention, such assembly being shown in vertical cross-section.

Referring to FIG. 1, there is shown a vehicle air conditioning system generally comprising an engine driven compressor 10, a condenser 12, an expander 14 and an evaporator 16. The system, apart from the present invention, operates in conventional manner with a predetermined amount of oil entrained in the refrigerant for circulation therewith and lubrication of the compressor. Moreover, the system may possibly contain some water which is, of course, undesirable.

Incorporated in the system between the evaporator and the compressor is the presently preferred construction of the accumulator-dehydrator assembly according to the present invention and generally designated as 18. The assembly comprises a two-piece casing having cup-shaped members 20 and 22 sealingly joined by an annular weld 24. Inlet and outlet fittings 26 and 28 are welded to the side of the top casing member 20 at diametrically opposite locations to adapt the accumulator-dehydrator assembly for connection in the suction line 30 between the evaporator and compressor.

Figure 2:
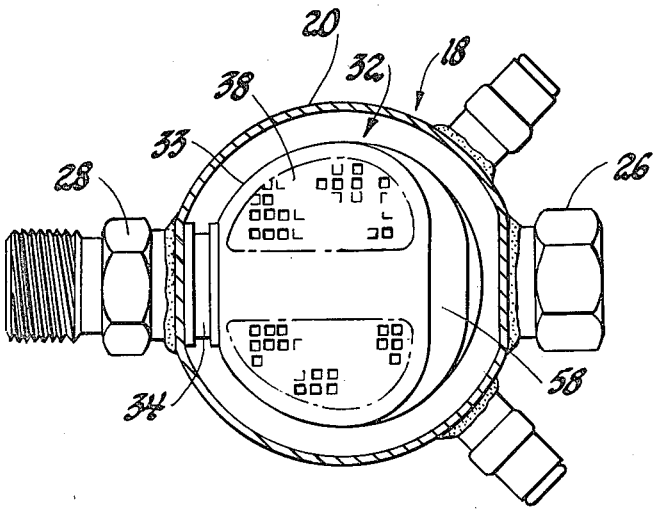
FIG. 2 is a view of the accumulator-dehydrator assembly taken along the line 2—2 in FIG. 1.

A desiccant container assembly 32 including a cup-shaped canister 33 is supported in the casing adjacent the top by securing the canister to an internal outlet fitting 34 which is snap-fitted with a ring 35 to the outlet fitting 28 from within the top casing portion 20. The canister 33 has a perforated top 38 (see FIG. 2) and an open bottom 40 and the internal outlet fitting 34 extends through the side of the canister and has a central vapor passage 42 therethrough whose inlet end 44 is located within the canister and whose outlet end 46 is sealingly connected to the passage 47 through the casing outlet fitting 28. A cup-shaped particulate filter 48 of matted material comprising a cylindrical piece 48 and disk-shaped end piece 50 is secured to the inlet end 44 of the internal fitting 34 within the canister. Packed about the filter within the canister is a desiccant 51. The desiccant 51 is continuously held in a packed condition about the filter 48 and against the perforated top 38 of the canister as desiccant attrition occurs by a disk-shaped perforated plate 52 which is biased upward by a helical coil spring 54. The spring 54 seats on an annular flange 56 of the canister extending radially inwardly and about the bottom opening 40 thereof.

In addition, the desiccant canister 33 is provided with a flattened portion 58 forming a baffle on its exterior side in the path of the passage 59 through the casing inlet fitting 26. The baffle 58 stimulates separation of the incoming refrigerant and oil into liquid and vapor components with the vapor components stratifying about the elevated desiccant container assembly 32 (including the top thereof) while the liquid components collect on the bottom of the casing. As a result, all of the vapor components in the casing are forced to enter the desiccant canister through both the top and bottom (perforated top 38 and perforated bottom plate 52) and then must pass through the desiccant 51 and thereafter the particulate filter 48 to reach the vapor passage 42. The vapor is only then free to flow through the vapor passage 42 and out the casing outlet passage 47 to the compressor 10. This allows the desiccant 51 to very effectively absorb any water entrained in the refrigerant while the particulate filter 48 thereafter further prevents the release of any liquid to the compressor while also preventing the escape of any particulates thereto.

Then as to the collected liquid (refrigerant and oil) in the bottom of the casing, there is provided a pick-up tube 60 which extends vertically upward from the bottom of the casing through a center opening 62 in the perforated spring biased desiccant retainer plate 52 and thence takes a bend passing through the packed desiccant 51 to the internal outlet fitting 34 where it is sealingly connected thereto. A filter screen assembly 66 is mounted on the lower end of the tube 60 about its open inlet end and serves to screen out any foreign matter. The upper end of the tube (its outlet end) is connected through a flow restricting orifice 68 to the vapor passage 42 adjacent its inlet end 44. As a result, the vapor flow through the vapor passage 42 produces a venturi effect which induces restricted liquid refrigerant and oil flow up through the liquid passage provided by the pick-up tube 60 and thence limited atomized refrigerant and oil flow out through the vapor passage 42 along with the vapor components passed through the desiccant so that any collected liquid refrigerant and oil is maintained in circulation to the compressor.

The above described preferred embodiment is illustrative of the invention which may be modified within the scope of the appended claims.

The embodiments of the invention in which an exclusive property or privilege is claimed are defined as follows:

1. In an accumulator-dehydrator assembly for an air conditioning system wherein refrigerant and oil and possibly water are circulated, a casing having a top and a bottom and an inlet for receiving refrigerant and oil and an outlet for discharging same, a container supported in said casing adjacent the top thereof, said container containing a desiccant exposed to the interior of said casing, a vapor passage having an inlet located within the desiccant in said container and an outlet connected to said casing outlet, said container having an exterior forming a baffle in the path of said casing inlet to stimulate separation of the incoming refrigerant and oil into liquid and vapor components whereby the vapor components stratify about said container while the liquid components collect on the bottom of said casing and whereby all of the vapor components in said casing are forced to pass through said desiccant and thence said vapor passage to said casing outlet allowing the desiccant to effectively adsorb any water entrained therein, and a restricted liquid passage having an inlet located adjacent the bottom of said casing and an outlet connected to said vapor passage at a point intermediate said vapor passage's inlet and outlet whereby the flow through said vapor passage induces restricted liquid refrigerant and oil flow through said liquid passage and thence limited atomized refrigerant and oil flow out through said outlet passage along with the vapor components passing through the desiccant.

2. In an accumulator-dehydrator assembly for an air conditioning system wherein refrigerant and oil and possibly water are circulated, a casing having a top and a bottom and an inlet for receiving refrigerant and oil and an outlet for discharging same, a container supported in said casing adjacent the top thereof, said container containing a desiccant exposed to the interior of said casing, a vapor passage having an inlet located within the desiccant in said container and an outlet connected to said casing outlet, a particulate filter located within the desiccant in said container and covering said inlet of said vapor passage, said container having an exterior forming a baffle in the path of said casing inlet to stimulate separation of the incoming refrigerant and oil into liquid and vapor components whereby the vapor components stratify about said container while the liquid components collect on the bottom of said casing and whereby all of the vapor components in said casing are forced to pass through said desiccant and thence said vapor passage to said casing outlet allowing the desiccant to effectively adsorb any water entrained therein, and a restricted liquid passage having an inlet located adjacent the bottom of said casing and an outlet connected to said vapor passage at a point intermediate said vapor passage's inlet and outlet whereby the flow through said vapor passage induces restricted liquid refrigerant and oil flow through said liquid passage and thence limited atomized refrigerant and oil flow out through said outlet passage along with the vapor components passing through the desiccant.

3. In an accumulator-dehydrator assembly for an air conditioning system wherein refrigerant and oil and possibly water are circulated, a casing having a top and a bottom and an inlet for receiving refrigerant and oil and an outlet for discharging same, a container supported in said casing adjacent the top thereof, said container containing a desiccant, said container having a perforated top and bottom exposing the interior of said casing to the desiccant, said perforated bottom being relatively movably mounted in said container and biased upward by a spring to maintain the desiccant in a packed condition in said container, a vapor passage having an inlet located within the desiccant in said container and an outlet connected to said casing outlet, said container having an exterior forming a baffle in the path of said casing inlet to stimulate separation of the incoming refrigerant and oil into liquid and vapor components whereby the vapor components stratify about said container while the liquid components collect on the bottom of said casing and whereby all of the vapor components in said casing are forced to pass through said desiccant and thence said vapor passage to said casing outlet allowing the desiccant to effectively adsorb any water entrained therein, and a restricted liquid passage having an inlet located adjacent the bottom of said casing and an outlet connected to said vapor passage at a point intermediate said vapor passage's inlet and outlet whereby the flow through said vapor passage induces restricted liquid refrigerant and oil flow through said liquid passage and thence limited atomized refrigerant and oil flow out through said outlet passage along with the vapor components passing through the desiccant.

* * * * *

UNITED STATES PATENT AND TRADEMARK OFFICE

CERTIFICATE OF CORRECTION

PATENT NO. : 4,331,001

DATED : May 25, 1982

INVENTOR(S) : Joe W. Jones

It is certified that error appears in the above—identified patent and that said Letters Patent is hereby corrected as shown below:

Column 2, line 30, "48" should read -- 49 --.

Signed and Sealed this

*Twenty-first* Day of *September 1982*

[SEAL]

*Attest:*

GERALD J. MOSSINGHOFF

*Attesting Officer*

*Commissioner of Patents and Trademarks*